United States Patent [19]

Hall

[11] 4,095,813

[45] Jun. 20, 1978

[54] SKI ATTACHMENT FOR HILL CLIMBING

[76] Inventor: Karen L. Hall, P.O. Box 1127, Hamilton, Mont. 59840

[21] Appl. No.: 751,325

[22] Filed: Dec. 16, 1976

[51] Int. Cl.[2] ..... A63C 7/10

[52] U.S. Cl. ..... 280/604; 280/11.37 G

[58] Field of Search ..... 280/11.37 R, 11.37 G, 280/604

[56] References Cited

U.S. PATENT DOCUMENTS

| | | | |
|---|---|---|---|
| 2,287,252 | 6/1942 | Kaufmann | 280/604 |
| 2,622,889 | 12/1952 | De Place | 280/11.37 G |

FOREIGN PATENT DOCUMENTS

| | | | |
|---|---|---|---|
| 192,606 | 12/1936 | Switzerland | 280/604 |

*Primary Examiner*—Joseph F. Peters, Jr.
*Assistant Examiner*—Gene A. Church
*Attorney, Agent, or Firm*—Clarence A. O'Brien; Harvey B. Jacobson

[57] ABSTRACT

An elongated net-like sleeve is provided in pairs for forward telescoping over the rear ends of a pair of skis and attachment thereto in substantially stationary position thereon. The net-type sleeves include portions thereof underlying the undersurfaces of the corresponding pair of skis and affording traction to the skis whereby hill climbing, steep descents and the pulling of toboggans over various snow and ice surfaces is facilitated. Each of the net-type sleeves includes an elongated braided multiple strand rope bent double upon itself to provide a loop at one end and a pair of free end sections at the other end. The two free end sections of the rope have longitudinally spaced transverse passages formed therethrough and each transverse passage slidably receives the other free end section of the rope section therethrough. The closed looped end of the sleeve is engaged over the upper surface of the associated ski forward of the toe piece whereby the latter may anchor the forward end of the sleeve against rearward displacement therealong and alternate interengaged portions of the rope section are disposed above and below the upper surface of the ski while the free terminal ends of the rope section are looped over the end edge of the ski and secured in position thereover. The sleeve is readily engaged with an associated ski by forwardly telescoping the sleeve over the rear end of the ski.

9 Claims, 4 Drawing Figures

SKI ATTACHMENT FOR HILL CLIMBING

BACKGROUND OF THE INVENTION

There have been many forms of attachments for skis heretofore provided for the purpose of increasing the traction of skis for ascending and descending steep slopes. However, most of these attachments are either too bulky for compact storage during periods of non-use, or they afford additional traction only on specific snow and ice surfaces. In addition, some forms of traction affording ski attachments are expensive to produce and require modifications of the skis upon which they are to be used. Accordingly, a need exists for an inexpensive traction affording attachment for skis which may be readily stored in a compact state and which will afford increase traction on substantially all types of snow and ice surfaces.

Examples of various forms of previously known attachments for increasing the traction of skis are disclosed in U.S. Pat. Nos. 1,783,833, 2,149,585, 2,150,988, 2,287,252, and 2,622,889. In addition, a disclosure of yet another form of similar ski attachment was disclosed in "Tracks & Banners" during 1968.

BRIEF DESCRIPTION OF THE INVENTION

The attachment of the instant invention comprises a net-type sleeve for forward telescoping over the rear ends of skis and is constructed in a manner to have its forward end anchored relative to the toe piece of the bindings of the associated ski. In addition, the sleeve includes alternate crossed portions thereof disposed above and below the upper and lower surfaces of the ski and a rear end which is readily removably securable in position on the associated ski. The crossed portions of the sleeve disposed beneath the undersurface of the associated ski offer a low profile and thus afford maximum surface portions thereof for increasing traction between the ski and snow as well as ice covered surfaces. Further, the crossed portions of the sleeve are slidably engaged with each other and thus individual segments of crossed portions may yield slightly without other segments thereof also yielding to cause slippage. Still further, the crossed portions are arranged relative to each other in a manner such that traction in forward and rearward directions is provided in addition to lateral traction in opposite directions. Accordingly, the ski attachment is not only useful in ascending and descending steep slopes but also useful in traversing steep slopes.

The main object of this invention is to provide attachment for skis which may be applied to the latter in order to afford increased traction.

Another object of this invention is to provide ski attachments constructed in a manner so as to provide additional traction in ascending as well as descending steep slopes.

Another object of this invention is to provide attachments for skis which will provide additional traction when traversing steep slopes.

Another important object of this invention is to provide attachments for skis which may be readily produced at a low cost.

Still another object of this invention is to provide attachments for skis in accordance with the preceding objects and which are constructed in a manner so as to be readily mounted on and removed from associated skis.

It is also an important object of this invention to provide attachments in accordance with the preceding objects which may be readily stored in a compact state.

A final object of this invention to be specifically enumerated herein is to provide attachments for skis in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
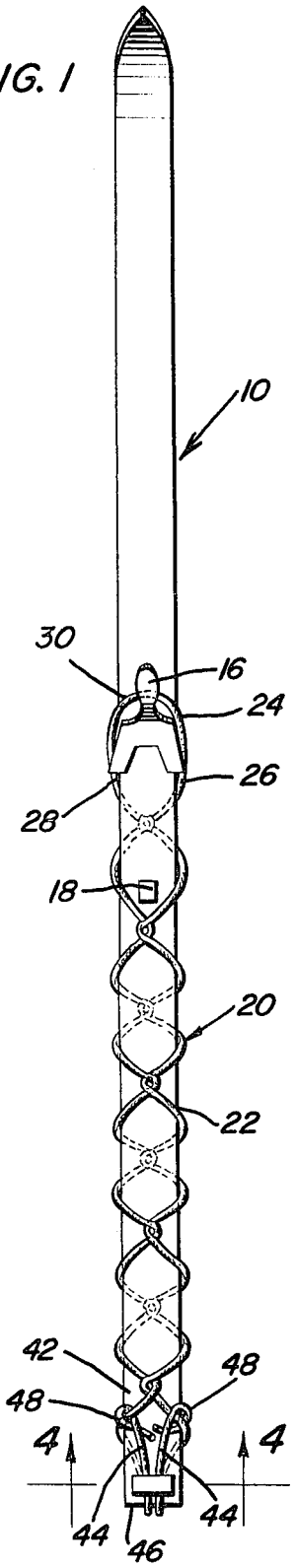
FIG. 1 is a top plan view of a ski having one of the attachments of the instant invention operatively mounted thereon.
Figure 2:
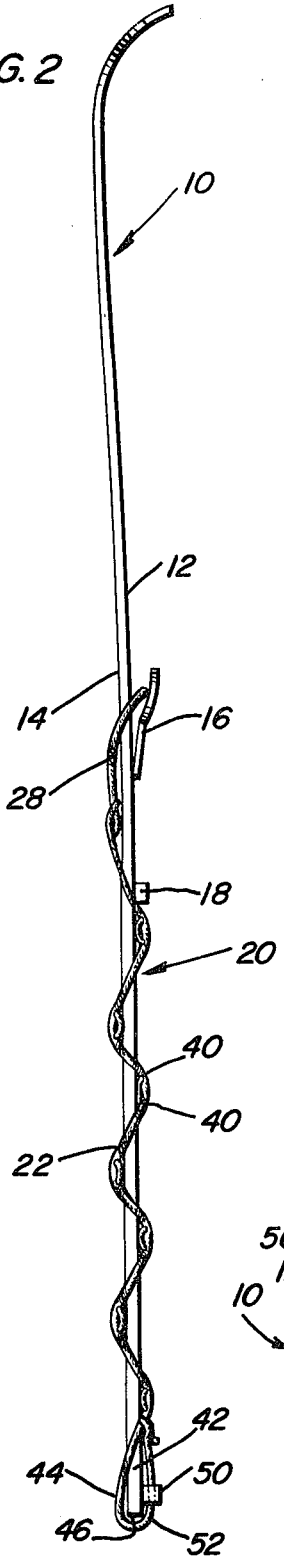
FIG. 2 is a side elevational view of the assemblage illustrated in FIG. 1 as seen from the left side thereof.
Figure 3:
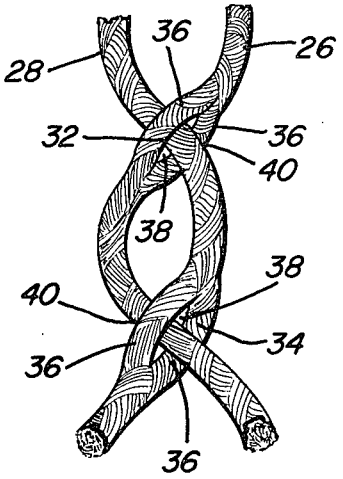
FIG. 3 is a fragmentary perspective view of a portion of the attachment in a non-tensioned state.
Figure 4:
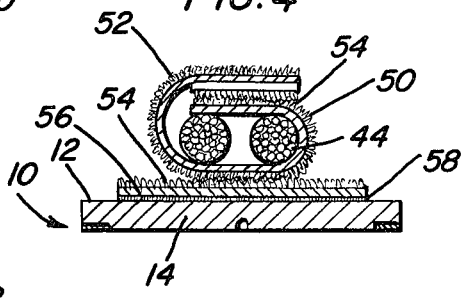
FIG. 4 is an enlarged fragmentary transverse sectional view taken substantially upon the plane indicated by the second line 4—4 of FIG. 1.

Referring now more specifically to the drawings the numeral 10 generally designates a conventional form of ski including upper and lower surfaces 12 and 14. The ski 10 is equipped with a forward toe piece 16 and a rear heel plate 18.

The attachment of the instant invention is referred to in general by the reference numeral 20 and comprises a net-type tubular sleeve 22 composed of a single length of flexible multiple strand braided rope 24.

The rope 24 includes a pair of rope sections 26 and 28 having front and rear ends with their front ends joined together by means of an integral intermediate portion 30. The rope sections 26 and 28 include longitudinally spaced portions 32 and 34, respectively, wherein the multiple strands thereof are parted and separated into separate strand bundles 36 defining a transverse passage 38 extending through the corresponding rope section. Each passage 38 has the other rope section slidably received therethrough and the passage of each section 26 and 28 through a corresponding passage defines a sliding interconnection 40 between the rope sections 26 and 28.

In operation, the sleeve 22 is forwardly telescoped over the rear end 42 of the ski 10 until the loop forming intermediate portion 30 may be engaged in front of the toe piece 16. Thereafter, the free rear ends 44 of the rope sections 26 and 28 are pulled rearwardly and looped over the rear end edge 46 of the ski 10 and tied or otherwise secured as at 48 to the sections 26 and 28. In addition, the free end portions 44 may be bound together by means of a strap member 50 secured thereabout over the upper surface of the rear end of the ski 10 and the strap member 50 may be anchored to the rear end of the ski 10 in any convenient manner.

However, the strap member 50 illustrated comprises a strap member having a first form of "Velcro" 52 secured over one side thereof and a second form of "Velcro" 54 secured to the opposite side of one end thereof whereby the ends of the strap member 50 may be releasably secured together in overlapped relation. In addition, a pad 56 is secured to the upper surface of the rear end of the ski 10 by adhesive 58 or other means and the pad 56 is provided with an upper layer of the second form 54 of "Velcro" whereby the strap member 59 may be removably anchored in position relative to the pad 56 by the engagement of the first and second forms of "Velcro" 52 and 54 with each other.

The traction attachment disclosed in the above noted "Track & Banners" also comprises a net-type of sleeve attachment. However, this previously known traction attachment does not include interconnections similar to the interconnections 40 in that it utilizes figure eight knots and such knots are considerably greater in vertical thickness. Although these greater vertical thickness portions offer traction on wet spring snow and very deep powder, they do not offer sufficient additional traction on hard pack and ice inasmuch as the knots do not penetrate the hard pack or the ice and tend to support the adjacent portions of the attachment and the ski completely above the hard pack and ice with the result that even less traction than that provided by a ski not equipped with a traction attachment is afforded. In addition, this previously known form of knotted attachment is considerably more bulky to store and is not capable of allowing individual segments thereof to shift relative to adjacent segments when engaged with less treacherous snow surfaces with the result that less traction, even in these conditions is afforded, as opposed to the traction provided by the attachment 10.

It is pointed out that the spacing of the first interconnection 40 away from the intermediate portion 30 and the distance between the forwardmost interconnection 40 and the next rearmost interconnection 40 is greater than the distance between successive rearward interconnections 40. The greater spacing between the interconnections 40 at the forward end of the attachment 20 is to allow the first interconnection 40 to be positioned substantially beneath the center of the foot attached to the ski and the next rearward interconnection 40 to pass over the top of the ski rearward of the heel plate 18.

The rope 24 is preferably constructed of polypropylene, bright in color for visibility, and the number of interconnections 40 provided on each attachment 20 is determined by the amount of additional traction desired.

The attachment 20 is not only useful in climbing steep slopes but is also useful in descending steep slopes, especially at dusk and when descending a narrow trail. In addition, the attachment 20 is very useful to patrollers pulling toboggans and to beginner skiers when descending steep slopes. Additionally, the attachment 20 offers considerable additional traction on hard pack and also on ice due to the low profile of the interconnections 40 enabling substantially all of the crossed portions of the rope sections 26 disposed beneath the undersurface 14 of the ski 10 to engage hard pack or ice.

The sliding interconnections 40 enable the net-type tubular attachment 20 to more readily clampingly engage the associated ski when the attachment is applied to the ski and tensioned longitudinally.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An elongated ski attachment for hill climbing, said attachment including a pair of elongated flexible multiple strand rope sections having front and rear end portions, attaching means securing said front end portions together, said rope sections, rearwardly of said portions, each including means defining a plurality of transverse passages therethrough at a plurality of points spaced therealong toward, but spaced from, said rear end portions, said rope sections being alternately and slidingly received through each other with each rope section portion extending through the other rope section being slidingly received through one of said transverse passages defined in the other rope section, said rear end portions of said rope sections extending sufficiently from the adjacent passage to enable said rear end portions to be looped over the rear end of the associated ski and secured to said rope sections adjacent said adjacent passage.

2. The combination of claim 1 wherein said rope sections are constructed of plastic rope.

3. The combination of claim 1 wherein said rope sections are constructed of braided rope strands.

4. The combination of claim 3 wherein said means defining transverse passages define portions of said rope sections in which the braided strands thereof are spread apart dividing the portions into substantially half thickness portions between which the other rope sections are slidingly received.

5. The combination of claim 4 wherein said rope sections are constructed of plastic rope.

6. The combination of claim 1 wherein said rope sections are formed of a single length of rope including a central portion integral with and comprising said means connecting said front end portions together.

7. The combination of claim 1 including an elongated strap removably securable about said rear end portions.

8. The combination of claim 1 including a snow ski including a forward binding portion projecting upwardly therefrom, said attachment being telescoped over the rear end of said ski with said attaching means engaged over said binding portion to anchor said attachment relative thereto and interengaged portions of said rope sections spaced along said attachment being alternately disposed over and under said ski, said rear end portions being looped over the rear end of said ski and anchored to an adjacent portion of said attachment disposed over said ski.

9. The combination of claim 8 including means removably securing said rear end portions together between said rear end of said ski and said adjacent portion of said attachment, and means removably anchoring said secured rear end portions to the upper surface of the rear end of said ski.

* * * * *